US006003666A

United States Patent [19]

Dougherty

[11] Patent Number: 6,003,666

[45] Date of Patent: Dec. 21, 1999

[54] METHOD AND APPARATUS FOR STORING AND SHIPPING HAZARDOUS MATERIALS

[75] Inventor: Dianne M. Dougherty, Menlo Park, Calif.

[73] Assignee: ChemTrace Corporation, Hayward, Calif.

[21] Appl. No.: 08/992,204

[22] Filed: Dec. 17, 1997

[51] Int. Cl.[6] ..... B65D 81/107; B65D 81/26

[52] U.S. Cl. ..... 206/204; 53/449; 206/523

[58] Field of Search ..... 206/204, 433, 206/523, 807; 215/250, 365; 53/449

[56] References Cited

U.S. PATENT DOCUMENTS

| | | | |
|---|---|---|---|
| 1,172,627 | 2/1916 | Nitardy et al. | 215/365 |
| 3,586,196 | 6/1971 | Barton et al. | 215/250 |
| 4,240,547 | 12/1980 | Taylor | 206/204 |
| 4,826,003 | 5/1989 | Levy | 206/523 |
| 4,853,266 | 8/1989 | Cullen | 206/204 |
| 4,872,563 | 10/1989 | Warder et al. | 206/523 |
| 4,949,840 | 8/1990 | Brown | 206/204 |
| 5,024,865 | 6/1991 | Insley | 206/204 |
| 5,450,948 | 9/1995 | Beausoleil et al. | 206/204 |
| 5,495,944 | 3/1996 | Lermer | 206/807 |
| 5,615,795 | 4/1997 | Tipps | 206/523 |

*Primary Examiner*—Jim G Foster
*Attorney, Agent, or Firm*—Hickman Stephens & Coleman, LLP

[57] ABSTRACT

A hazardous material and shipment system (kit) includes a containment box, a closeable bottle, a unitary foam positioning body, and an absorbent sleeve. The unitary positioning body is positioned within the containment box and is provided with an aperture. The closeable bottle has a screw cap, is made from a material compatible with the hazardous material, and fits within the aperture of the positioning body. An optional removable top member covers the aperture to secure the bottle therein. The bottle is preferably a part of a bottle assembly including a sealing tape, the absorbent sleeve, and a plastic bag, which provide multiple containments for liquid leaks and spills. A method for containing hazardous materials includes placing a desired amount of the hazardous material in a bottle body having a threaded neck and then engaging a screw cap with the threaded neck to provide a closed bottle with the hazardous material inside. The method further includes providing a containment box and a unitary positioning body disposed within the containment box that is made from a foam material which has an aperture sized to receive the bottle. The method further includes engaging the bottle with the aperture and sealing the box to contain the hazardous material therein.

29 Claims, 8 Drawing Sheets

METHOD AND APPARATUS FOR STORING AND SHIPPING HAZARDOUS MATERIALS

BACKGROUND OF THE INVENTION

This invention relates generally to containers for hazardous substances and, more particularly, to methods and apparatus for storing and shipping small quantities of hazardous materials for testing purposes.

The shipment of hazardous materials is strictly regulated by several National and International organizations. For example, both the International Air Transportation Association (IATA) and U.S. Department of Transportation (DOT) regulate the shipment of "dangerous goods." Under Section 2.7 of the IATA regulations and under 49 C.F.R. 173.4 and HM 181 of the DOT regulations, certain exceptions are made to the otherwise extremely stringent requirements for the shipment of dangerous goods. These exceptions are generally referred to as "Dangerous Goods In Excepted Quantities," or "Exceptions for Small Quantities."

In order to qualify for shipment under "Dangerous Goods In Excepted Quantities," the general rule is that no more than 30 mL of a hazardous liquid or 30 grams of a hazardous solid (such as oxidizers or corrosives) can be shipped within a single bottle. In addition, any container (e.g. box) enclosing the bottle holding the hazardous material must meet a number of Federally mandated tests including a drop test, a stack test, an internal pressure test, a Cobb water absorption test, and a vibration test. If the entire containment assembly passes these tests, it meets the aforementioned requirements and can be shipped by passenger or cargo aircraft. In addition, since regulations for air transport are more stringent than for ground transport, compliance with these air regulations ensures compliance with applicable ground transport regulations as well.

The purpose of the drop test is to access the package's ability to withstand mechanical hazards that occur in distribution, as specified in applicable United Nations and U.S. Department of Transportation Hazardous Materials (dangerous goods) documents. The requirements for this test can be found in USDOT 49 C.F.R., Subpart M, paragraph 178.603, UN Recommendations on the Transport of Dangerous Goods-9.73 IATA Dangerous Goods Regulations-10.3.3, ICAO Technical Instruction for the Safe Transport of Dangerous Goods by Air-Section 7, Chapter 4.3., incorporated herein by reference.

The purpose of the stack test is to determine the ability of the package to withstand a force applied to its top surface equivalent to the total combined weight of identical packages stacked on top of it during distribution. The height requirement for the stack test is a minimum of 3 meters (approximately 10 feet) including the test sample. The duration of the stack test is 24 hours.

In order to pass the stack test, the test sample must not leak. In composite packaging or combination packaging, there must be no leakage of the filling substance from the inner receptacle or the inner packaging. No test sample must show any deterioration which would adversely affect transport safety or any distortion liable to reduce its strength or to cause instability in stacks of packages. The regulations referring to the stacking test can be found in 47 C.F.R. Subpart M, paragraph 178.606, UN Recommendations on the Transport of Dangerous Goods-9.7.6, IATA Dangerous Goods Regulations-10.3.6, ICAO Technical Instructions for the Safe Transport of Dangerous Goods by Air-Section 7, Chapter 4.6., incorporated herein by reference.

The internal pressure test must be performed on metal, plastic, and composite packaging intended to contain liquids. Except for air transport, this test is not required for inner packaging of combination packaging. The appropriate regulations include USDOT 49 C.F.R. Subpart M, paragraph 178.605, UN Recommendations on the Transport of Dangerous Goods-9.7.5, IATA Dangerous Goods Regulations-10.3.5, and ICAO Technical Instructions for the Safe Transport of Dangerous Goods by Air-Section 7, Chapter 4.5., incorporated herein by reference.

The purpose of the water absorption test (referred to as the "Cobb" water absorption test) is to determine the quantity of water absorbed by non-bibulous paper and paper board in a specified amount of time under standardized conditions. This test is applied primarily to the outer packaging material. The appropriate regulations include USDOT subpart L, paragraph 178.516, UN Recommendations of the Transport of Dangerous Goods-9.6.11, IATA Dangerous Goods Regulations-10.2.1, ICAO Technical Instructions for the Safe Transport of Dangerous Goods by Air-Section 7, Chapter 3.1.10, and ISO International Standard 535-1976(E) 178.516(b)(1), incorporated herein by reference.

Each package must be capable of withstanding, without rupture of leakage, the vibration test. The packages are constrained horizontally and are left free to move vertically, to bounce, and to rotate. The packaging is then vibrated for about an hour. Immediately following the period of vibration, each package is removed from the platform, turn on its side, and observe for any evidence of leakage. A packaging passes the vibration test if there is no rupture of leakage from any of the packages. The appropriate regulation is 49 C.F.R., subpart M, paragraph 178.608, incorporated herein by reference.

It will therefore be appreciated that even when shipping dangerous goods in "Excepted Quantities," there are a number of stringent regulatory requirements that must be met. In the past, these conditions have been met by shipping such materials in a standard "4G" package designed and certified for use in shipping much larger quantities (e.g. 250 mL to 1 L). The 4G box is over-designed for "Dangerous Goods in Excepted Quantities" and, therefore, is larger, more cumbersome, more ill-fitting, and more expensive than necessary. A typical 4G package includes a container for the sample that is packed along with a loose, absorbent material (e.g. Vermiculite) inside of a metal can, which is then packed within a fiberboard box of specified characteristics. The smallest typical 4G package to hold a single sample is 9 inches by 5 inches by 5 inches.

Another disadvantage of shipping hazardous materials in standard 4G boxes is that it requires special documentation to be completed before air transportation carriers will accept the boxes for transport. This documentation is specified under IATA regulations entitled "Shipper's Declaration of Hazardous Materials." All commercial transportation services require a significant surcharge for processing this special documentation.

An additional drawback with most of the prior art 4G packages is that the absorbent material is loosely packed in the container and can settle during transport, creating only a partial protection in case of leakage. Furthermore, many 4G packages rely on the absorbent material, such as the aforementioned Vermiculite, for their cushioning properties. Unfortunately, as the absorbent material settles and packs, the cushioning properties of the material are reduced.

SUMMARY OF THE INVENTION

The present invention includes a sampling kit which allows for the safe storage and transport of hazardous materials in accordance the "Dangerous Goods In Excepted Quantities" requirement of the IATA and the DOT. With the proper use of the kit, a user is assured that the container for the hazardous materials will meet all applicable transport regulations including the drop test, the stack test, the internal pressure test, the Cobb water absorption test, and the vibration test. In addition, embodiments of the present invention permit the transport of multiple hazardous materials in multiple bottles within one containment box.

A hazardous material storage and shipment system of the present invention includes a containment box, a unitary foam positioning body, a closeable and leak-proof bottle, and an optional top foam member. The positioning body is located within the containment box and has at least one aperture extending from a top surface into the body. The closeable bottle has a bottle body provided with a threaded neck and a screw cap engageable with the threaded neck. The bottle is made from a material that is compatible with a hazardous material to be stored or shipped, and has an internal volume sufficient to contain a desired amount of hazardous material. The bottle, when placed within an absorbent envelope, is sized to fit snugly within the aperture of the positioning body. Therefore, when the bottle is placed within the absorbent envelope and inserted into the aperture, the bottle is securely positioned within the internal volume of the containment box and will not move around within the box to any substantial degree. The top member is configured to cover the top surface of the positioning body such that the aperture is covered, when the size of the bottle allows, i.e. the top member is optional in some embodiments of the invention. When the top member is engaged with the positioning body, a bottle within the aperture is further secured and protected within the internal volume of the containment box. The top member is preferably sized such that the combination of the positioning body and the top member substantially fill the entire internal volume of the containment box.

An adhesive vinyl tape is preferably used to seal the neck of the bottle body to the screw cap after the hazardous material has been placed within the bottle. The absorbent sleeve that is preferably engaged with the bottle body has the capacity to absorb virtually the entire fluid content of the bottle, should the bottle leak. Also preferably, a plastic bag is sealed around the bottle and the absorbent sleeve as an additional back up against leakage.

The containment box is preferably made from a corrugated cardboard material. The bottle is preferably made from a chemically resistant plastic material selected from the group consisting essentially of chemically resistant hydrocarbon polymers, fluorocarbon polymers, fluorinated ethylene propylene, and polyetheretherketone. The positioning body preferably includes a plurality of foam plastic plies that are adhered together to form the unitary body. The foam material is preferably a low density, closed-cell polyethylene foam.

A method for containing hazardous materials in accordance with the present invention includes placing a desired amount of a hazardous material in a bottle body having a threaded neck and engaged in a screw cap with the threaded neck to provided a closed bottle with the hazardous material inside. The method also includes providing a containment box enclosing a unitary positioning body made from a foam material and having at least one aperture extending from a top surface into the body, engaging the body with the aperture providing in the unitary positioning body, and sealing the box that contain the hazardous material. Preferably, the method also includes placing a top member made from a foam material over the top surface of the positioning body prior to sealing the box. Still further, the bottle is sealed with a sealing tape after engaging in the screw cap with the threaded neck and prior into engaging the bottle with the aperture. The method still further preferably includes engaging an absorbent material with the bottle body after sealing the bottle and prior into engaging the bottle body with the aperture. Lastly, the method preferably includes enclosing the bottle and the absorbent material in a plastic bag after engaging the absorbent material with the bottle body and prior into engaging the bottle body with the aperture.

Therefore, a method and apparatus are provided which allows for the convenient and safe shipment of hazardous materials in accordance with the regulations for "Dangerous Goods In Excepted Quantities" under section 2.7 of the IATA regulations and in accordance with the DOT regulations of 49 C.F.R. 173.4 and HM 181. The kit is pre-tested to comply with the aforementioned drop, stack, internal pressure, Cobb water absorption, and vibration tests, and is capable of shipping multiple samples in multiple bottles stored within a single containment box. As noted previously, the smallest typical 4G package to hold a single sample is 9 inches by 5 inches by 5 inches. The apparatus of the present invention can hold 6 samples in a package that size.

As noted previously, a major disadvantage of shipping hazardous materials in standard 4G boxes is that it requires expensive special documentation to be completed before air transportation carriers will accept the boxes for transport. In contrast, the package system of the present invention does not require this special documentation and therefore avoids the associated surcharge by the commercial transportation service. This results in very significant cost savings when using the packaging system of the present invention.

These and other advantages of the present invention will become apparent upon reading the following detailed descriptions and studying the various figures of the drawings.

DETAILED DESCRIPTION OF THE PREFERRED EMBODIMENTS

Figure 1:
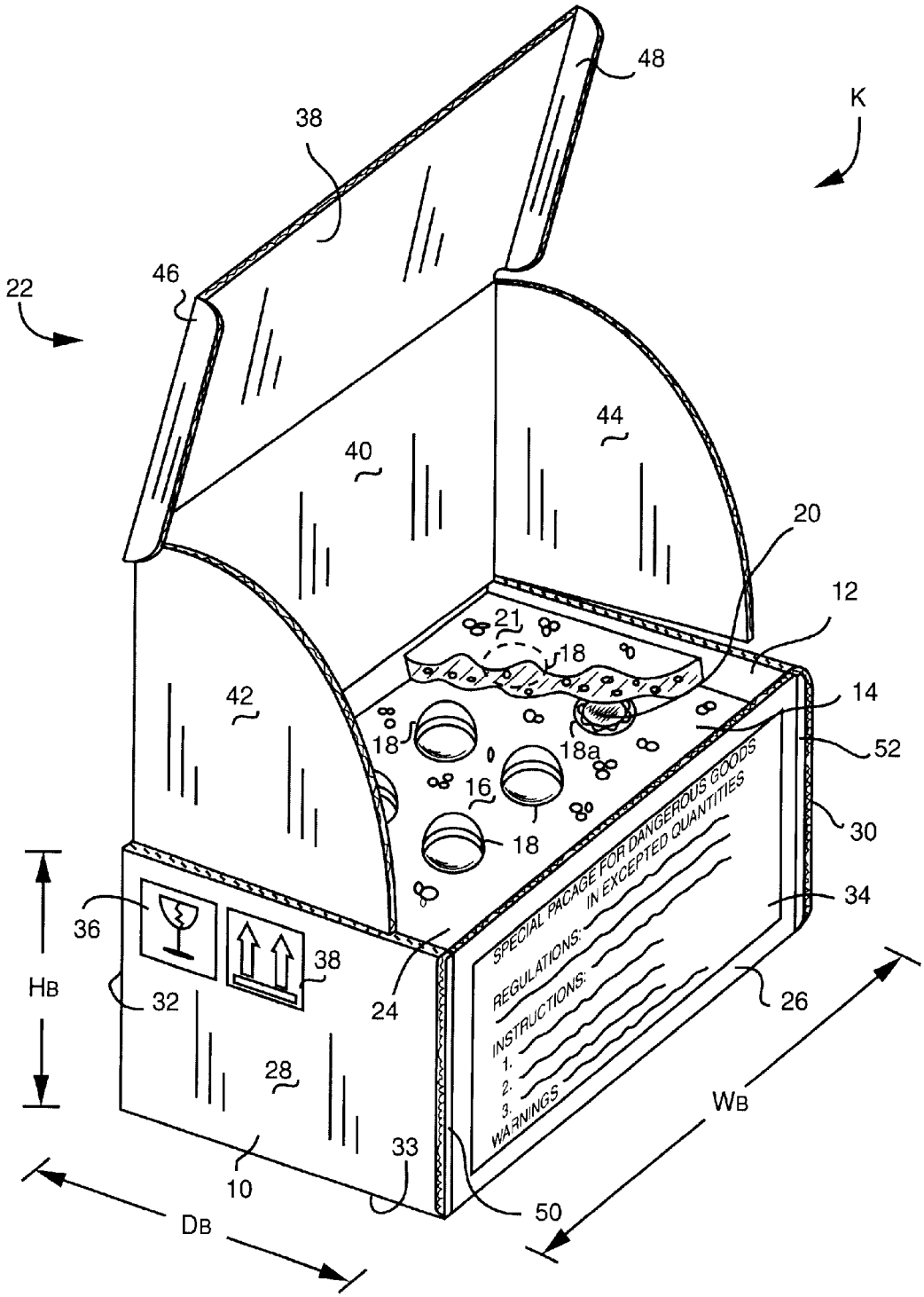
FIG. 1 is a perspective view of a hazardous material storage and shipment system ("kit") in accordance with the present invention.

In FIG. 1, a hazardous material storage and shipment system ("kit") K in accordance with the present invention includes a containment box 10 having an internal volume 12, a unitary positioning body 14 having a top surface 16 and a plurality of apertures 18, a closeable bottle assembly 20 disposed in one of the apertures 18*a* of the positioning body 14, and a top member 22. The containment box 10 includes a lid section 22 which is shown in this figure in an open position for the purpose of illustration. As will be discussed subsequently, the lid section 22 folds over the open top 24 of the containment box 10 into a closed position for storage and/or shipment. Since the hazardous materials are often samples used for chemical analysis purposes, the present invention may also be referred to as a "hazardous sample" storage and shipment system or "kit."

Figure 14:
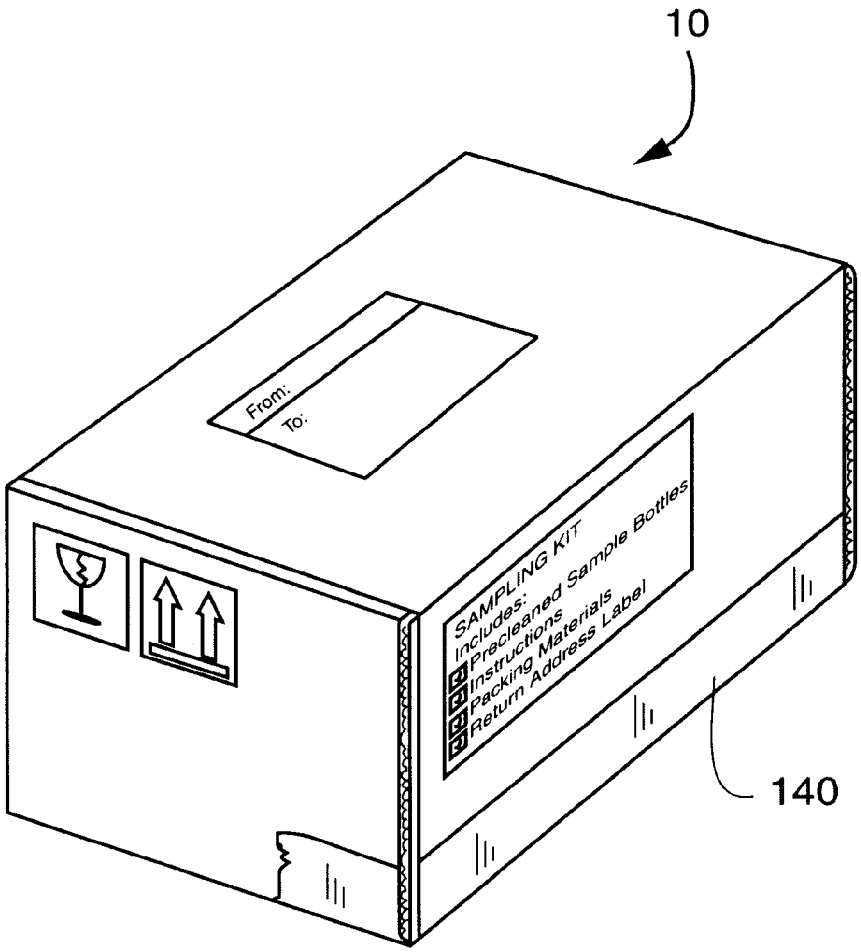
FIG. 14 is a perspective view of the hazardous material storage in shipment system after it is sealed and ready for storage and/or shipment.

The containment box 10, in the present example, is a generally right rectangular prism when closed (see also, FIG. 14). As such, the containment box 10 includes a number of sides including a front side 26, a left side 28, a right side 30, and a back side 32. The box 10 further includes a closed bottom 33 and the aforementioned open top 24. Various indicia are preferably printed on various surfaces of the box 10, such as an instruction/warning indicia 34 printed on the front side 26. Various other indicia are also preferably printed on the box 10, including the "fragile contents" indicia 36, and the "this side up" indicia 38 on the left side 28. While the positioning of the various indicia is somewhat arbitrary, it is preferred that the instruction/warning indicia 34 be provided on the front side 26. This is because it is easily visible to a user when the hazardous materials are being placed within the containment box 10, but will be hidden from view by a flap 38 of the lid section 22 when the box 10 is closed and sealed for storage or shipment. This is to prevent confusion among the shippers and handlers of the sealed box 10.

The lid section 22 includes a top 40, a pair of wings 42 and 44, the aforementioned flap 38 and a pair of locking tabs 46 and 48. When the lid section 22 is in a closed position, the wings 42 slide into the internal volume 12 of the box 10 along the inner surfaces of left side 28 and right side 30, respectively. The top 40 of the box then covers the open top 24 to close the top of the box, and the flap 38 covers the front side 26 of the box as described previously. The locking tab 46 engages a slot 50 located between the left side 28 and the front side 26, and the locking tab 48 engages a slot 52 located between the front side 26 and the right side 30 of the box 10. When in this "closed" position, the containment box 10 is strongly mechanically closed, and can be sealed (as will be discussed subsequently) by tape, stapes, etc.

Figure 2:
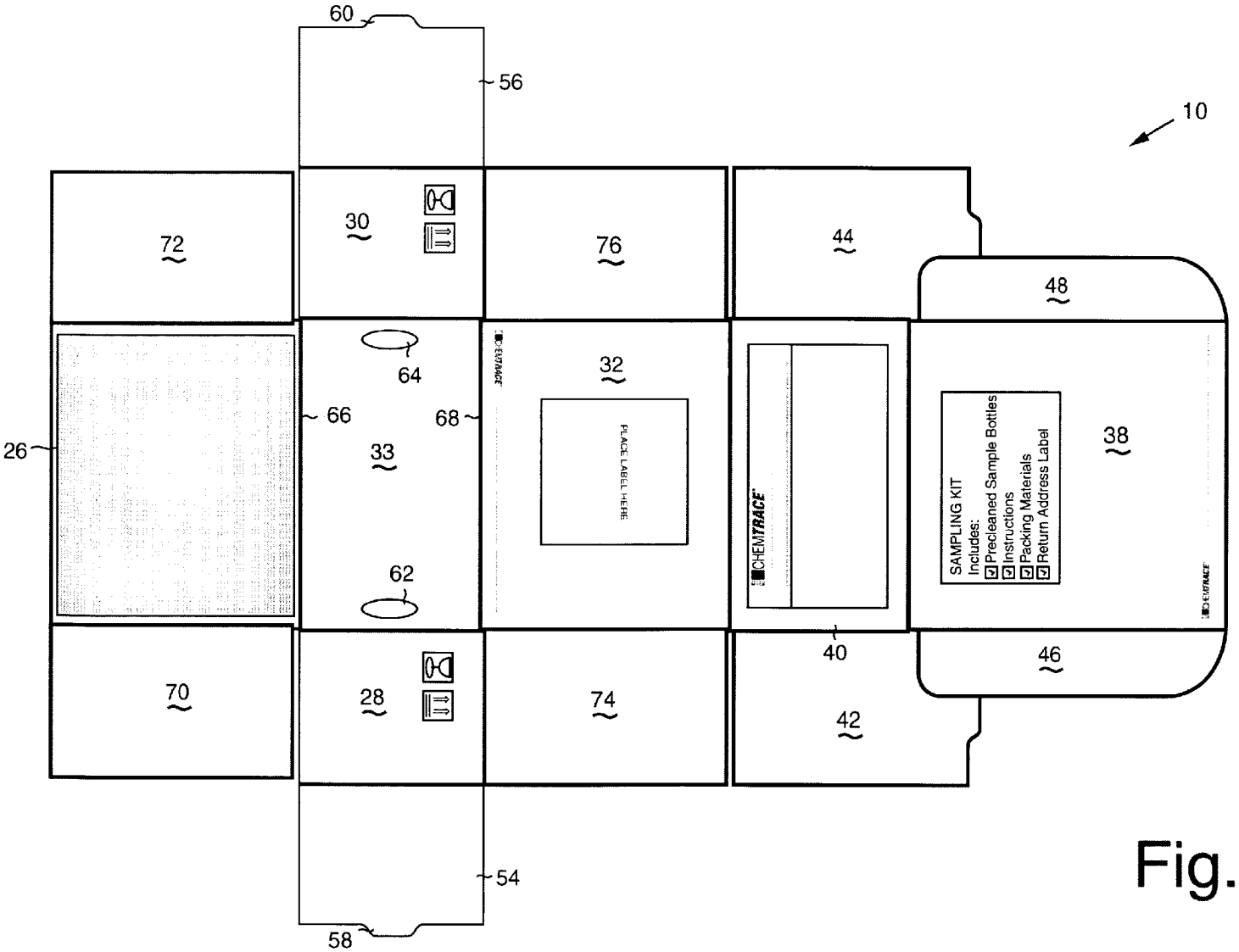
FIG. 2 is a top plan view of the containment box in a flattened configuration.

In FIG. 2, the containment box 10 is shown in its flattened ("unassembled") form as received from a box manufacturer. Preferably, the box is assembled as illustrated in FIG. 1 prior to sale in kit form K. Shown in FIG. 2 are the front side 26, bottom 33, back side 32, top 40, flap 38, wings 44 and 42, locking tabs 48 and 46, right side 30, and left side 28. Also are seen are a pair of flaps 54 and 56 which extend from sides 28 and 30, respectively. These flaps 54 and 56 include tabs 58 and 60, respectively, which can engage slots 62 and 64, respectively, of the bottom 33.

The box 10 is preferably made from a sturdy corrugated cardboard material such as fiberboard. The corrugated cardboard includes two planar cardboard surfaces separated by a corrugated cardboard inner layer. The manufacturer of corrugated cardboard and the formation of corrugated cardboard into a flattened box configuration, such as shown in FIG. 2, is well-known to those skilled in the art.

To assemble the box 10 of FIG. 2, the front side 26 and the back side 32 are folded at seams 66 and 68, respectively. Tab sections 70 and 72 of the front side 26 and tab sections 74 and 76 of the back section 32 are folded inwardly towards each other, and the flaps 54 and 56 are folded over the tab sections and engage the slots 62 and 64 to create the box configuration as illustrated in FIG. 1.

Figure 3:
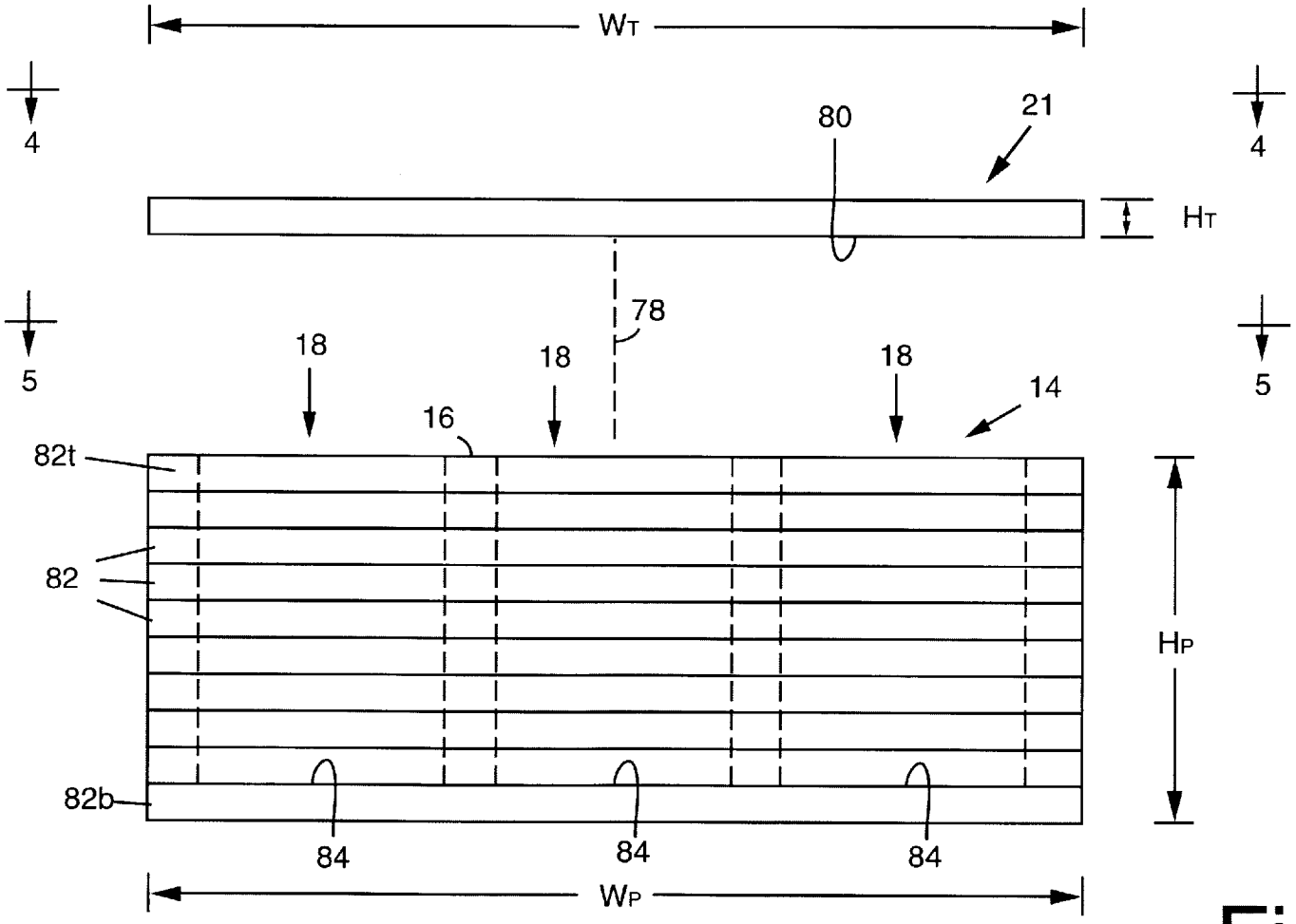
FIG. 3 is a front elevational view of a positioning body and a top member in accordance with the present invention.

In FIG. 3, the unitary positioning body 14 and the top member 21 are shown in a front elevation view. The top member 21 is shown elevated above the top surface 16 of the positioning body 14 as illustrated by the broken lines 78. In use, the bottom surface 80 of the top member 21 rest on top of the top surface 16 of the positioning body 14. Preferably, the bottom surface 80 of the top member 21 is configured similarly to the top surface 16 of the positioning body 14. Also preferably, the combined height of the positioning body 14 and the top member 21 is about the same as the internal height of the box 10. Therefore, the height $H_B$ of the box 10 is approximately equal to the sum of the height $H_P$ of the positioning body 14 and the height $H_T$ of the top member 21. In addition, the width $W_B$ of the box 10 is approximately the same as the width $W_P$ of the positioning body 14 and the width $W_T$ of the top member 21. Also, the depth $D_B$ of box 10 (see FIG. 1) is about the same as the depth $D_D$ of the positioning body 14 and the depth $D_T$ of the top member 21. In consequence, the combination of the positioning body 14 and the top member 21, when at the bottom surface 80 and the top member 21 is in contact with the top surface 16 of the positioning body 14 substantially fills the internal volume 12 of the box 10. This is to prevent the positioning body 14 and top member 21 from moving excessively within the volume 12 of the box 10. However, the fit of these members within the box 10 may be somewhat loose, allowing a small amount of movement, e.g. one quarter-one half inch of movement within the volume 12 of the box 10.

The dimensions of an exemplary hazardous material storage and shipment system are as follows:

| Box 10 | Positioning Body 14 | Top Member 21 |
|---|---|---|
| $H_B$ = 5⅞" | $H_P$ = 4⅞" | $H_T$ = ½" |
| $W_B$ = 10" | $W_P$ = 9⅛" | $W_T$ = 9⅛" |
| $D_B$ = 6⅞" | $D_P$ = 6⅞" | $D_T$ = 6 7/16" |

These dimensions can be of the order of plus or minus ¼" and still provide a good mutual fits of the various parts of the assembly. In addition, for an exemplary bottle 86 having a diameter of 1¾", the diameter of the apertures 18 are approximately 2 3/16" to leave room for the absorbent sleeve 120. Again, these are exemplary dimensions for the illustrated embodiment, and other dimensions and dimensional relationships exist for other embodiments of the present invention.

With continued reference to FIG. 3, both the positioning body 14 and the top member 21 are, essentially, right rectangular prisms. The height of the positioning body 14 is, clearly, much greater than the height $H_T$ of the top member 21. Both the positioning body 14 and the top member 21 are preferably made from a foam material. More particularly, these members are preferably made from a closed-cell plastic foam material having a low density. A suitable low density, closed-cell plastic foam is polyethylene foam. Polyethylene foam is conveniently purchased in sheets, e.g. in 9/16" flat sheets. These sheets can then be cut to shape to form the top member 21, and can be cut to shape, hole punched and then laminated together to form the unitary positioning body 14. This provides for an economical manufacture of the positioning body 14, and results in less waste in the manufacturing process than to produce the positioning body structure from a single block of foam.

Low density polyethylene foam is preferred for the present invention in that the positioning body 14 is provided primarily for positioning (i.e. blocking and bracing) rather than cushioning. This is because the containment bottles of the present invention are not made from glass or other fragile materials but, rather, a durable chemically inert plastic material. Since the positioning body 14 is primarily used for positioning and not cushioning, the less expensive low density foam is preferred. As used herein, "low density foam" includes polyethylene of a 1.2–1.4 GB density. For example, a suitable low density foam is T-LAM foam.

The polyethylene foam described above for both the positioning body and the top member 21 is also well suited for chemical applications because it is a closed-cell foam, rather than an open-cell foam, such as a foam made from polyurethane. As such, the closed-cell polyethylene will not absorb or soak up liquids, and can be wiped down and reused in a convenient fashion.

As seen in FIG. 3, positioning body 14 is preferably made from a number of the aforementioned sheets for layers of polyethylene foam. More particularly, the positioning body 14 is made from a number of plies 82 including a top ply 82*t* and a bottom ply 82*b*. Preferably, the apertures 18 extend from the top surface 16 of ply 82*t* into the body 14. Also preferably, the apertures 18 do not extend completely through the body 14. In this example, the aperture 18 extends through the plies 82, starting with the top ply 82, but does not extend through the bottom ply 82*b*. This will provide a cushioned base 84 for each of the aperture 18. However, as an alternate embodiment, the aperture 18 extend fully through the positioning body 14, and a separate body member (not shown) similar to the top member 21 can be provided below the positioning body 14. In this alternate embodiment, the combined heights of the positioning body 14, the top member 21, and the bottom member (not shown) should again be approximately the same, or slightly less, than the height $H_B$ of the box 10.

Figure 4:
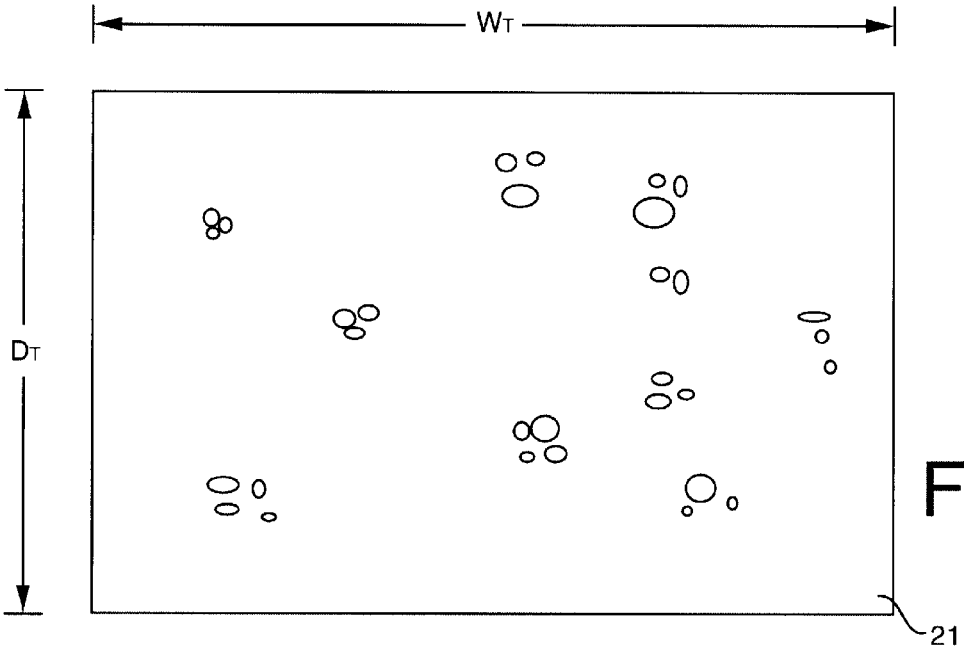
FIG. 4 is a top plan view taken along line 4—4 of FIG. 3.
Figure 5:
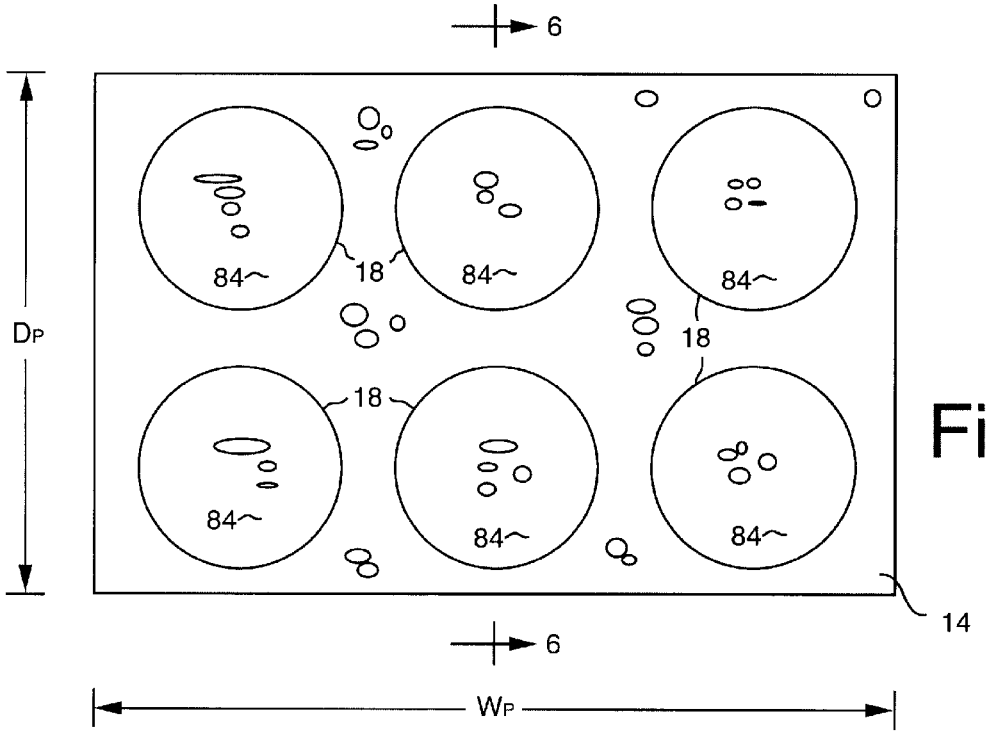
FIG. 5 is a top plan view taken along line 5—5 of FIG. 3.

FIGS. 4 and 5 are top plan views of the top member 21 and the positioning body 14, respectively, of the present invention. As seen from the top, the top member 21 is preferably a rectangular section of closed-cell polyurethane foam. The top member 21 has a depth $D_T$ and a width $W_T$ dependent on the application. Similarly, the positioning body 14 has a depth $D_P$ and a width $W_P$ that matches the depth and width of the top member 21. As seen in FIG. 5, the aperture 18 are preferably circular in cross section, creating a substantially cylindrical aperture 18 within the positioning body 14. The cushioning base 84 comprising the top surface of bottom ply 82*b* can also be seen in this view.

Figure 6:
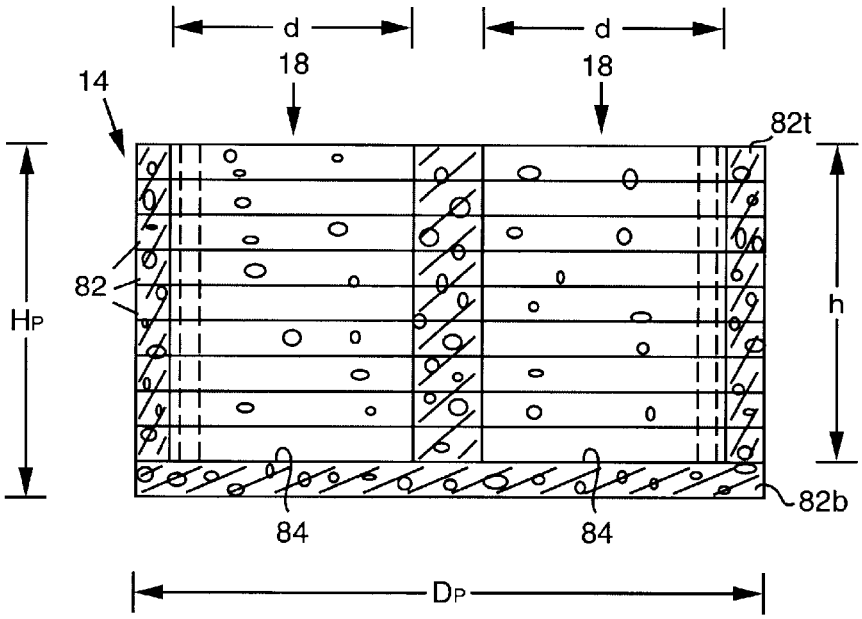
FIG. 6 is a cross-sectional view taken along line 6—6 of FIG. 5.

As noted previously, the positioning body 14 is preferably made from a number of plies of the aforementioned low density closed-cell plastic polyethylene foam. In this instance, adjacent plies 82 are preferably adhered together in some fashion to form the unitary body 14. A unitary body is preferred to minimize shifting within the containment box, i.e. to provide a stable positioning for the bottle(s). The plies can be fused together using heat and pressure, or by using a suitable solvent applied between adjacent surfaces, and or by gluing them together using a suitable adhesive. Preferably, the aperture 18 are formed in each applicable ply 82prior to adhering the plies together to form the unified body. This is because it is easier to form the aperture in a thin ply than it is to form it in the unified body itself. For example, the aperture 18 can be formed in each ply 82 using a conventional punch-press. FIG. 6 is a cross-sectional view taken along line 6—6 of FIG. 5. The generally cylindrical apertures 18 can been seen in this figure to have a diameter d and a height h. The height of the aperture is, essentially, the height of the plies 82 through which the aperture extends. The bottom of the aperture is at the base surface 84 of the bottom ply 82*b*.

Figure 7:
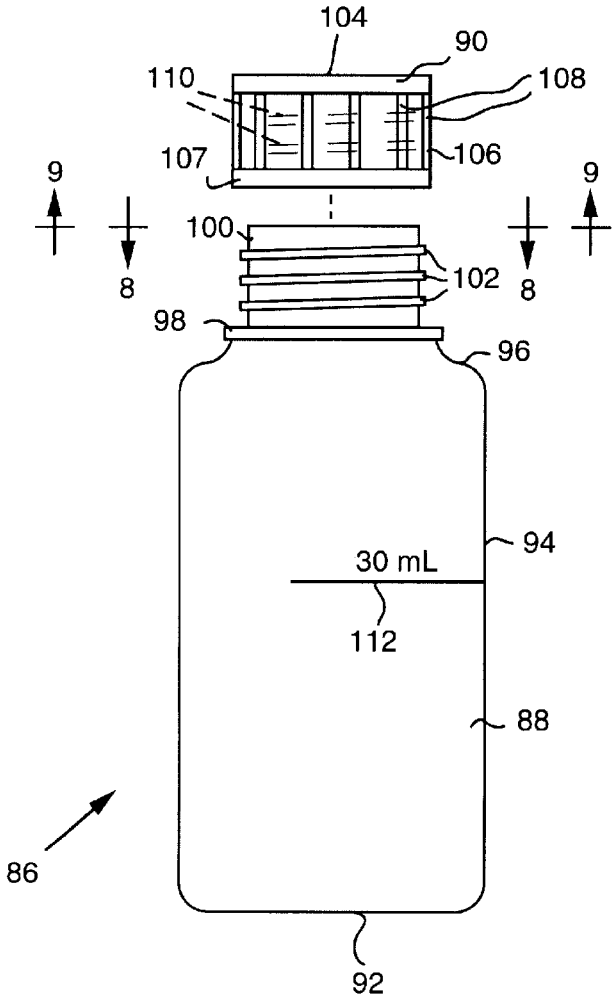
FIG. 7 is an exploded view of a bottle in accordance with the present invention.
Figure 8:
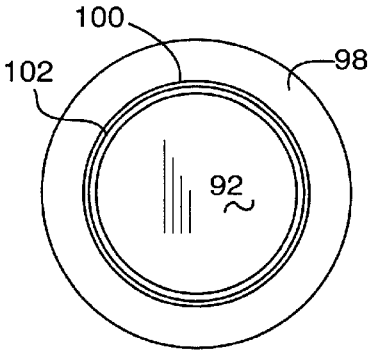
FIG. 8 is a top plan view taken along line 8—8 of FIG. 7.
Figure 9:
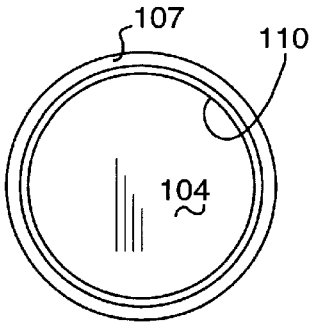
FIG. 9 is a bottom plan view taken along line 9—9 of FIG. 7.

In FIG. 7, 8, and 9, a bottle 86 forming a part of the bottle assembly 20 is illustrated. FIG. 8 is a top plan view of a bottle body 88 taken along line 8—8 of FIG. 7, and FIG. 9 is a bottom plan view of a cap 90 taken along line 9—9 of FIG. 7. The bottle 86 therefore comprises the bottle body 88 and the cap 90. The bottle body 88 has a base 92, a cylindrical sidewall 94 terminating at a shoulder 96, and a collar 98. A neck 100 of the bottle body 88 includes threads 102. The cap 90 has a top portion 104 and a skirt 106 and is cylindrical in shape such that it can engage the substantially cylindrical neck 100 of the bottle body 88. An outside surface of the cap 90 is provided with grip portions 108, while the inside surface of the skirt 106 is provided with threads 110 (shown in broken lines) which engage the threads 102 of the bottle body 88. A mark or other indicia 112 is provided on the bottle body 88 to indicate the maximum amount of hazardous substance to be poured into the bottle body 88. Alternatively, the bottle can be sized so that it can hold no more than the maximum amount of hazardous substance allowed (e.g. 30 mL of liquid or 30 gm. of solids). However, it is preferable that the bottle be sized so that it has an internal volume somewhat greater than the volume required by the desired amount of the hazardous material so that there is sufficient head space within the bottle. By "head space", it is meant that there is a free volume of air above the top level of the sample to provide for possible expansion of the sample.

The bottle is preferably made from a plastic material that is compatible with the hazardous material be stored or shipped. Plastic is desirable over glass in most circumstances since it is shatter-proof and, depending on its composition, resistant to most chemicals. Preferably, the plastic of the bottle is selected from the group consisting of essentially of chemically resistant hydrocarbon polymers (e.g. polyethylene or "PE") and fluorocarbon polymers (e.g. perfluoroalkoxy or "PFA", fluorinated ethylene propylene or "FEP", and polyetheretherketone or "PEEK"). In this present preferred embodiment, pre-cleaned PFA (e.g. Teflon®) bottles are used. Other preferred clean bottles are described in co-pending U.S. patent application Ser. No. 08/723,861, filed Sep. 30, 1996, assigned to the assignee of the present invention, which is incorporated herein by reference for all purposes. For example, a bellows-type bottle body, in addition to a cylindrical bottle body, is described in the aforementioned U.S. patent application Ser. No. 08/723,861, incorporated herein by reference. In some applications, a bellows-type bottle is preferred, while in other applications, a cylindrical bottle or other shaped bottle may be preferred.

Figure 10:
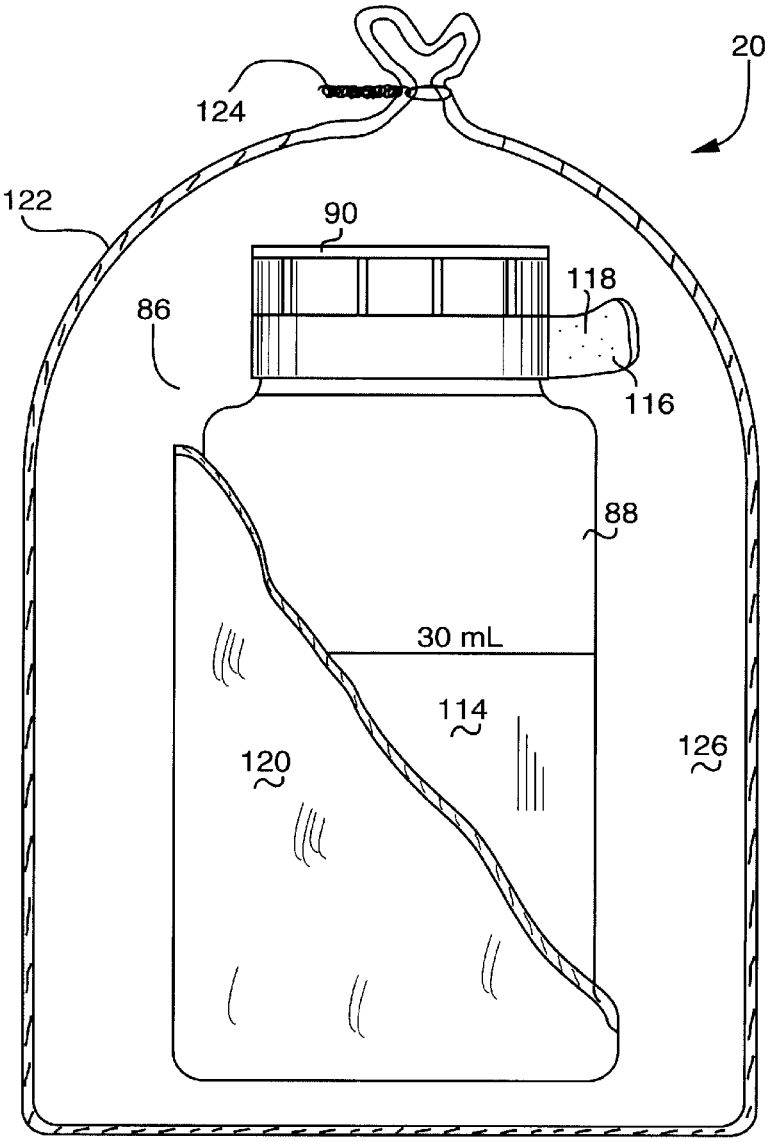
FIG. 10 is a partially broken front elevational view of a bottle, absorbent sleeve, sealing tape, and sealing bag in accordance with the present invention.

The bottle 86 forms a part of the bottle assembly 20 of FIG. 1. A preferred bottle assembly 20 in accordance with the present invention is illustrated in FIG. 10. With this preferred bottle assembly, a hazardous liquid 114 (or a hazardous solid) is disposed within the bottle body 88 and the cap 90 is engaged with the threaded neck of the bottle body 88. Next, a self-adhesive tape 116 is wrapped around the neck 100 and the bottom of the cap 90 to further seal the bottle 86. Preferably, the tape 116 is a vinyl tape including an adhesive 118, although other suitable materials can be used. For example, electrical or strapping tape can be used to seal the neck of the bottle body to the cap. Next, an absorbent sleeve 120 made from a highly absorbent material is disposed around the bottle body 88 to absorb any liquid 114 that might escape the body 86. Finally, the tape bottle and absorbent sleeve is enclosed within a plastic bag 122 and sealed, such as with a twist tie 124. Alternatively, the plastic bag (which is typically made from polyethylene) can have a "zip-lock" type closure, a taped closure, etc. making the twist tie 124 unnecessary. Typically, the plastic bag 122 will be about 4 mils in thickness. Of course, in actual use, the bag 122 will be collapsed around the bottle 86 and absorbent sleeve 120 to minimize the amount of air space 126 within the bag, so that the entire body assembly snugly fits within an aperture 18 of the positioning body 14.

In consequence, the hazardous liquid 114 has multiple safeguards against leakage. First, it would have to leak between the cap 90 and the bottle body 88, then it would have to leak past the tape 116, then it would have to fail to be absorbed by the absorbent material 120, and then it would have to escape from bag 122, and finally it would have to escape from the aperture 18 of the positioning body 14. It should be noted that the closed- cell materials of the positioning body 14 are, essentially, liquid impermeable, forming yet another escape barrier.

Figure 11:
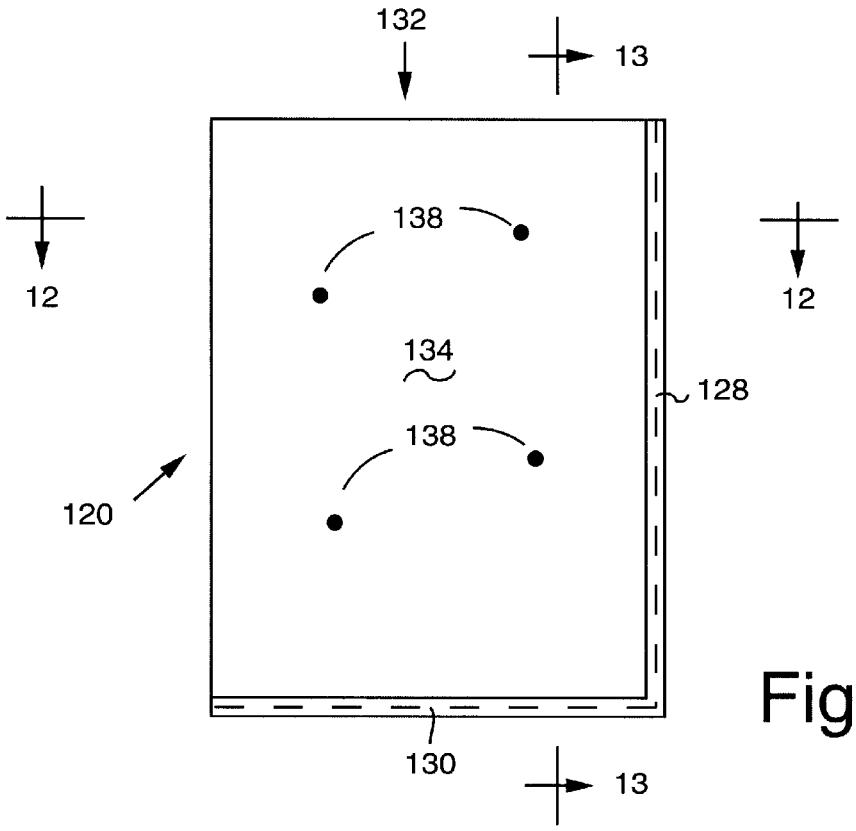
FIG. 11 is a front elevational view of the absorbent sleeve of the present invention.
Figure 12:
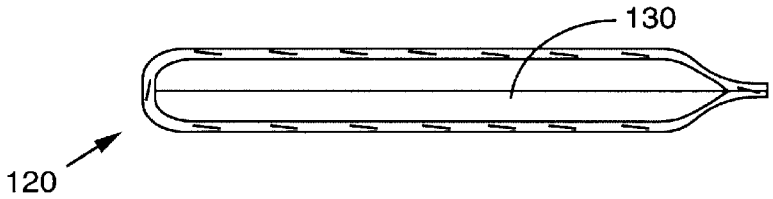
FIG. 12 is a cross-sectional view taken along line 12—12 of FIG. 11.
Figure 13:
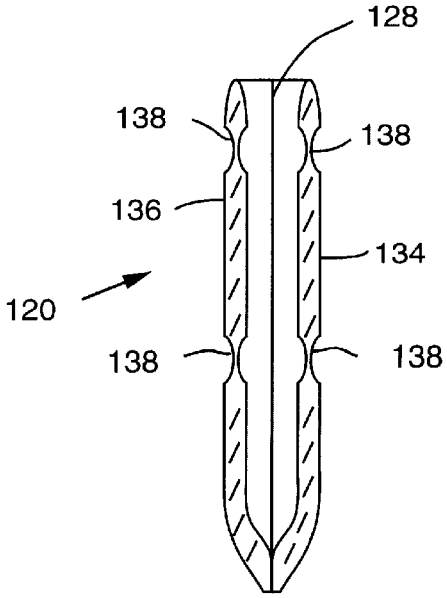
FIG. 13 is cross-sectional view taken along line 13—13 of FIG. 11.

A preferred configuration for the absorbent sleeve is illustrated in FIGS. 11, 12, and 13. More specifically, FIG. 11 is a front elevational view, FIG. 12 is a cross-sectional view taken along line 12—12 of FIG. 11, and FIG. 13 is cross-sectional view taken along line 13—13 of FIG. 11.

The absorbent material 20 can be obtained, for example, as SafeSend Hazardous Materials Packaging Products from 3M Corporation of St. Paul, Minn., or can be custom made from absorbent sheets of material. When formed into sleeves, they are often referred to as "sorbant envelopes." The material is sealed along a vertical edge 128 and a horizontal edge 130 to provide a sleeve or "envelope" having an open mouth 132. The seams 128 and 130 are preferably formed by a heat sealing process, as will be appreciated by those skilled in the art. In addition, the front sidewall 134 and back sidewall 136 of the sleeve 120 is "tacked" at multiple points indicated by 138. These stacks 138 inhibit the fibrous filler of the absorbent material 120 from shifting over time.

In FIG. 14, the box 10 has been closed as described previously and has been sealed such as with packing tape 140. When hazardous materials have been prepared and enclosed within the box 10 as described previously and after the box has been sealed, it is ready for storage and/or shipment in accordance with all applicable rules and regulations.

While this invention has been described in terms of several preferred embodiments, there are alterations, permutations, and equivalents which fall within the scope of this invention. It should also be noted that there are may alternative ways of implementing both the process and apparatus of the present invention. It is therefore intended that the following appended claims be interpreted as including all such alterations, permutations, and equivalents as fall within the true spirit and scope of the present invention.

What is claimed is:

1. A hazardous material storage and shipment system comprising:

a containment box having an internal volume;

a unitary positioning body made from a foam material, said body being disposed within said containment box and having a top surface and a bottom surface, said positioning body being provided with at least one aperture extending from said top surface into said body; and a closeable bottle having a bottle body provided with a threaded neck and a screw cap engageable with said threaded neck, said bottle being made from a material compatible with a hazardous material to be stored or shipped, said bottle having an internal volume sufficient to contain a desired amount of said hazardous material, and being sized to fit within said aperture, wherein said aperture does not extend fully through said body, wherein said positioning body is made from a closed-cell plastic foam material.

2. A hazardous material storage and shipment system as recited in claim 1 further comprising:

a top member made from a foam material and configured to cover said top surface of said positioning body such that said at least one aperture is covered, where the combination of said positioning body and said top member substantially fill said internal volume of said containment box.

3. A hazardous material storage and shipment system as recited in claim 1 wherein said hazardous material is a liquid, and further including an absorbent material disposable around said bottle body, where the combination of said bottle and said material are configured to fit within said aperture, said absorbent material having an absorption capacity sufficient to absorb fluid up to said desired amount.

4. A hazardous material storage and shipment system as recited in claim 1 wherein said closed-cell plastic foam material is a low density foam.

5. A hazardous material storage and shipment system as recited in claim 4 wherein said low density, closed-cell plastic foam is a polyethylene foam.

6. A hazardous material storage and shipment system as recited in claim 5 wherein said bottle is made from a chemically resistant plastic material.

7. A hazardous material storage and shipment system as recited in claim 1 wherein said bottle is made from a chemically resistant plastic material selected from the group consisting of essentially of chemically resistant hydrocarbon polymers, fluorocarbon polymers, fluorinated ethylene propylene, and polyetheretherketone, and wherein said bottle is selected from the group of bellows-type bottles and cylindrical bottles.

8. A hazardous material storage and shipment system as recited in claim 3 wherein said bottle is made from a chemically resistant plastic material selected from the group consisting of essentially of chemically resistant hydrocarbon polymers, fluorocarbon polymers, fluorinated ethylene propylene, and polyetheretherketone.

9. A hazardous material storage and shipment system as recited in claim 8 wherein said bottle has an internal volume that is sufficiently greater than said desired amount of said hazardous material to provide head space within said bottle.

10. A hazardous material storage and shipment system as recited in claim 8 wherein said bottle has an internal volume substantially greater than said desired amount of said hazardous material.

11. A hazardous material storage and shipment system as recited in claim 10 wherein said bottle is provided with an indicia to indicate that said bottle is containing about said desired amount of said hazardous material.

12. A hazardous material storage and shipment system as recited in claim 1 wherein said containment box includes a hinged lid that can pivot between an open position and a closed position wherein at least a portion of said lid covers said top surface.

13. A hazardous material storage and shipment system as recited in claim 12 wherein said containment box further includes a plurality of sides, and wherein said lid further includes at least one locking tab which can engage a side portion of said containment box when said lid is in said closed position to inhibit said lid from moving to said open position.

14. A hazardous material storage and shipment system as recited in claim 13 wherein said box has four closed sides, a closed bottom, and an open top that can be closed by said lid.

15. A hazardous material storage and shipment system as recited in claim 14 wherein said box is made from a corrugated cardboard material.

16. A hazardous material storage and shipment system as recited in claim 15 wherein at least one of instructions and warnings concerning the use of the hazardous material storage and shipment system is printed on said box.

17. A hazardous material storage and shipment system as recited in claim 16 wherein said at least one of instructions and warning are printed on an outside surface of at least one of said sides of said box.

18. A hazardous material storage and shipment system as recited in claim 17 wherein said at least one side of said box upon which said at least one of said instructions and warnings are printed is at least partially covered by a portion of said lid adjacent said at least one locking tab.

19. A hazardous material storage and shipment system as recited in claim 1 further comprising a band wrapped around said neck of said bottle after said screw cap is engaged with said neck of said bottle.

20. A hazardous material storage and shipment system as recited in claim 19 wherein said band includes a self-adhesive vinyl tape.

21. A hazardous material storage and shipment system as recited in claim 1 wherein said bottle is made from a chemically resistant plastic material selected from the group consisting of essentially of chemically resistant hydrocarbon polymers, fluorocarbon polymers, fluorinated ethylene propylene, and polyetheretherketone, and said bottle has an internal volume substantially greater than said desired amount of said hazardous material.

22. A hazardous material storage and shipment system as recited in claim 21 wherein said bottle is provided with an indicia to indicate that said bottle is containing about said desired amount of said hazardous material.

23. A hazardous material storage and shipment system comprising:

a containment box having an internal volume;

a unitary positioning body made from a foam material said body being disposed within said containment box and having a top surface and a bottom surface, said positioning body being provided with at least one aperture extending from said top surface into said body;

a closeable bottle having a bottle body provided with a threaded neck and a screw cap engageable with said threaded neck, said bottle being made from a material compatible with a hazardous material to be stored or shipped said bottle having an internal volume sufficient to contain a desired amount of said hazardous material and being sized to fit within said aperture;

a band wrapped around said neck of said bottle after said screw cap is engaged with said neck of said bottle;

absorbent material disposable around said bottle; and a plastic bag enclosing said absorbent material and said bottle, such that the combination of said bottle, said absorbent material, and said bag are configured to fit within said aperture.

24. A hazardous material storage and shipment system comprising:

box having an internal volume and a lid;

positioning body having a top surface and a bottom surface said positioning body being provided with at least one aperture extending from said top surface into said positioning body;

bottle having a bottle body provided with a threaded neck and a screw cap engageable with said threaded neck, said bottle being made from a material compatible with a hazardous liquid sample to be stored or shipped, said bottle having an internal volume sufficient to contain a desired amount of said hazardous material, and being sized to fit within said aperture; and absorbent material disposable around said bottle, where the combination of said bottle and said absorbent material are configured to fit within said aperture, said absorbent material having an absorption capacity sufficient to absorb fluid up to said desired amount, wherein said positioning body and said lid are made from a closed-cell, low density polyethylene foam.

25. A hazardous material storage and shipment system as recited in claim 24 further comprising:

a top member configured to cover said top surface of said positioning body such that said at least one aperture is covered, where the combination of said positioning body and said top member substantially fill said internal volume of said box.

26. A hazardous material storage and shipment system comprising:

a box having an internal volume;

a positioning body having a top surface and a bottom surface, said positioning body being provided with at least one aperture extending from said top surface into said positioning body;

a bottle having a bottle body provided with a threaded neck and a screw cap engageable with said threaded neck, said bottle being made from a material compatible with a hazardous liquid sample to be stored or shipped, said bottle having an internal volume sufficient to contain a desired amount of said hazardous material, and being sized to fit within said aperture;

an absorbent material disposable around said bottle means, where the combination of said bottle and said absorbent material are configured to fit within said aperture, said absorbent material having an absorption capacity sufficient to absorb fluid up to said desired amount; and a bag enclosing said absorbent material and said bottle, such that the combination of said bottle, said absorbent, and said bag are configured to fit within said aperture.

27. A method for containing hazardous materials comprising the steps of:

placing a desired amount of a hazardous material in a bottle body having a threaded neck and engaging a screw cap with said threaded neck to provide a closed bottle with said hazardous material inside, said a closed bottle being made from a material compatible with said hazardous material, said material being selected from the group consisting of essentially of chemically resistant hydrocarbon polymers, fluorocarbon polymers, fluorinated ethylene propylene, and polyetheretherketone;

providing a containment box enclosing unitary positioning body made from a foam material, said body being disposed within said containment box and having a top surface and a bottom surface, said positioning body being provided with at least one aperture extending from said top surface into said body, engaging said bottle with said aperture provided in a unitary positioning body made from a foam material;

sealing said box to contain said hazardous material;

placing a top member made from a foam material over said top surface of said positioning body prior to sealing said box;

sealing said bottle after engaging said screw cap with said threaded neck and prior to engaging said bottle with said aperture; and engaging an absorbent material with said bottle body after sealing said bottle and prior to engaging said bottle body with said aperture.

28. A method for containing hazardous materials as recited in claim 27 further comprising enclosing said bottle and said absorbent material in a plastic bag after engaging said absorbent material with said bottle body and prior to engaging said bottle body with said aperture.

29. A method for containing hazardous materials comprising:

placing, a desired amount of a hazardous material in a bottle body having threaded neck and engaging a screw cap with said threaded neck to provide a closed bottle with said hazardous material inside, said a closed bottle being made from a material compatible with said hazardous material, said material being selected from the group consisting of essentially of chemically resistant hydrocarbon polymers, fluorocarbon polymers, fluorinated ethylene propylene, and polyetheretherketone;

providing a containment box enclosing unitary positioning body made from a foam material, said body being disposed within said containment box and having a top surface and a bottom surface, said positioning body being provided with at least one aperture extending from said top surface into said body;

engaging said bottle with said aperture provided in a unitary positioning body made from a foam material; and sealing said box to contain said hazardous material, wherein said bottle body is a bellows-type bottle body.

* * * * *